US012303023B2

(12) United States Patent
Jeffries

(10) Patent No.: US 12,303,023 B2
(45) Date of Patent: May 20, 2025

(54) SMALL FORM FLOOR STANDING KIOSK FOR INTERACTIVE TECHNOLOGY DEVICES

(71) Applicant: Robert Aubrey Jeffries, Gananoque (CA)

(72) Inventor: Robert Aubrey Jeffries, Gananoque (CA)

( * ) Notice: Subject to any disclaimer, the term of this patent is extended or adjusted under 35 U.S.C. 154(b) by 567 days.

(21) Appl. No.: 17/392,199

(22) Filed: Aug. 2, 2021

(65) Prior Publication Data

US 2022/0192362 A1 Jun. 23, 2022

Related U.S. Application Data

(63) Continuation of application No. 15/968,105, filed on May 1, 2018, now abandoned.

(60) Provisional application No. 62/492,914, filed on May 1, 2017.

(51) Int. Cl.
*A47B 19/10* (2006.01)

(52) U.S. Cl.
CPC ..... *A47B 19/10* (2013.01); *A47B 2200/0075* (2013.01); *A47B 2200/008* (2013.01); *A47B 2220/0077* (2013.01)

(58) Field of Classification Search
CPC ..... A47B 19/10; A47B 2200/0075; A47B 2200/008
USPC ..... 248/451
See application file for complete search history.

(56) References Cited

U.S. PATENT DOCUMENTS 5,271,669 A * 12/1993 Pearlson ..... G09F 27/00 312/316
5,769,369 A * 6/1998 Meinel ..... B60N 3/001 248/176.1
5,860,237 A * 1/1999 Johnson ..... G09F 15/0056 40/607.1
6,325,343 B1 * 12/2001 Flagg ..... A47B 19/08 248/459
6,997,117 B1 * 2/2006 Mitjans ..... A47B 19/10 108/150
7,336,258 B1 * 2/2008 Goetsch ..... G06F 3/039 248/278.1
9,743,759 B1 * 8/2017 Ramirez ..... F16M 11/28

FOREIGN PATENT DOCUMENTS

DE 202009000964 U1 * 8/2009 ..... G07F 9/10
DE 202012007849 U1 * 1/2014 ..... A47B 21/00

* cited by examiner

*Primary Examiner* — Todd M Epps
(74) *Attorney, Agent, or Firm* — Benoit &Cote Inc.; Danny Higgins

(57) ABSTRACT

A small form floor standing kiosk for interactive technology devices is proposed for use as a floor standing support and presentation stand for any weight and size appropriate technology devices displaying, and/or collecting input from, providing coupons, an experience, and feedback, to people.

18 Claims, 16 Drawing Sheets

INTERACTIVE STAND

*This stand, or kiosk, provides a small form support for any type of device that displays information or invites interaction. It is designed for any presentation of information and/or collection of input with a combination of any devices of suitable weight and size(1). It is designed to sit on the floor and present the device to an individual who is standing(2). The visual design of the stand is integrated with the optimum functional requirements of human ergonomics with a small form of display stand. A unique integration of materials and textures uses crumb rubber from recycled tires(3) and any metal bent from sheet to create the superstructure (4) and the spring plate (5). The rubber lower component integrates any choice of colour and the upper metal component is any type of metal finish, perforation, pattern, applied colour, coating or applied chemical technique, applied to the base metal. The design also includes instances of wrapping of the metal component with decorative applied film designs that are installation location specific.*

INTERACTIVE STAND

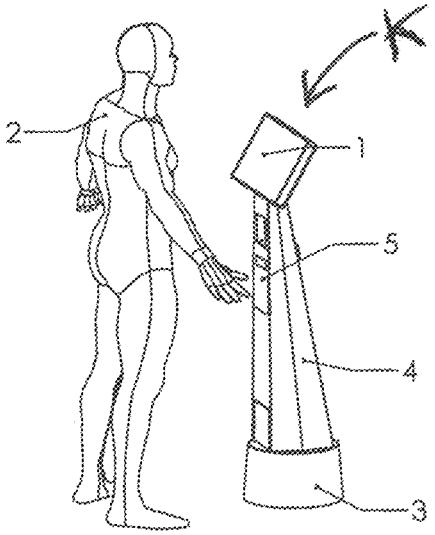

FIG. 1

*This stand, or kiosk, provides a small form support for any type of device that displays information or invites interaction. It is designed for any presentation of information and/or collection of input with a combination of any devices of suitable weight and size(1). It is designed to sit on the floor and present the device to an individual who is standing(2). The visual design of the stand is integrated with the optimum functional requirements of human ergonomics with a small form of display stand. A unique integration of materials and textures uses crumb rubber from recycled tires(3) and any metal bent from sheet to create the superstructure (4) and the spring plate (5). The rubber lower component integrates any choice of colour and the upper metal component is any type of metal finish, perforation, pattern, applied colour, coating or applied chemical technique, applied to the base metal. The design also includes instances of wrapping of the metal component with decorative applied film designs that are installation location specific.*

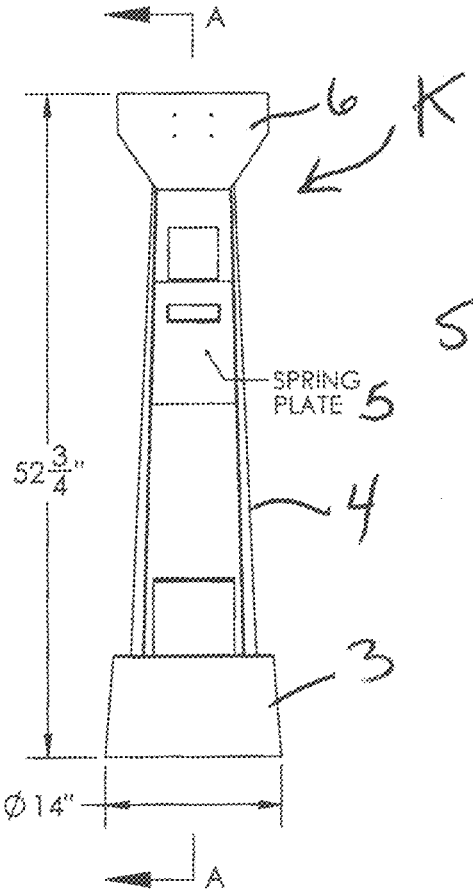

FIG. 2

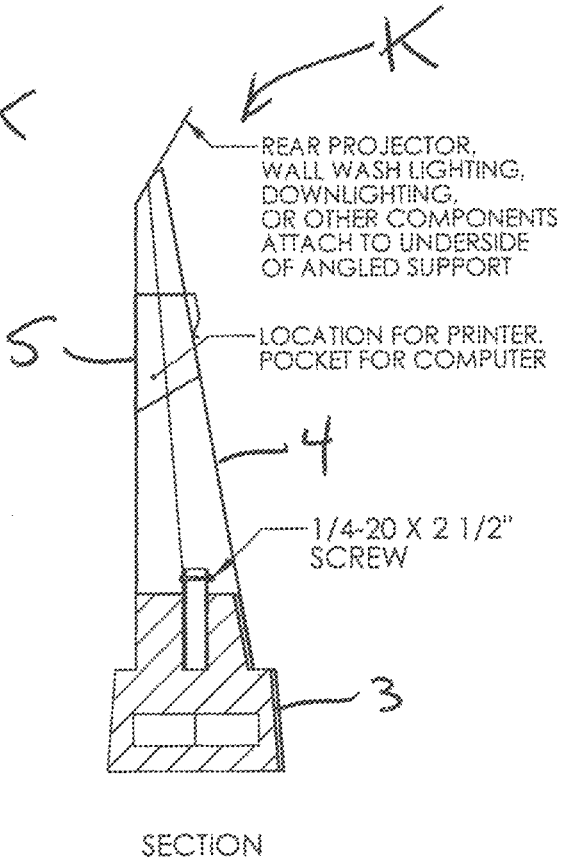

FIG. 3

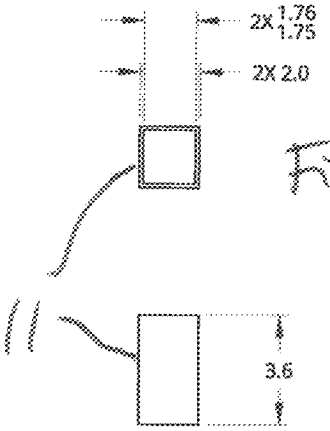
Fig. 22
Fig. 23
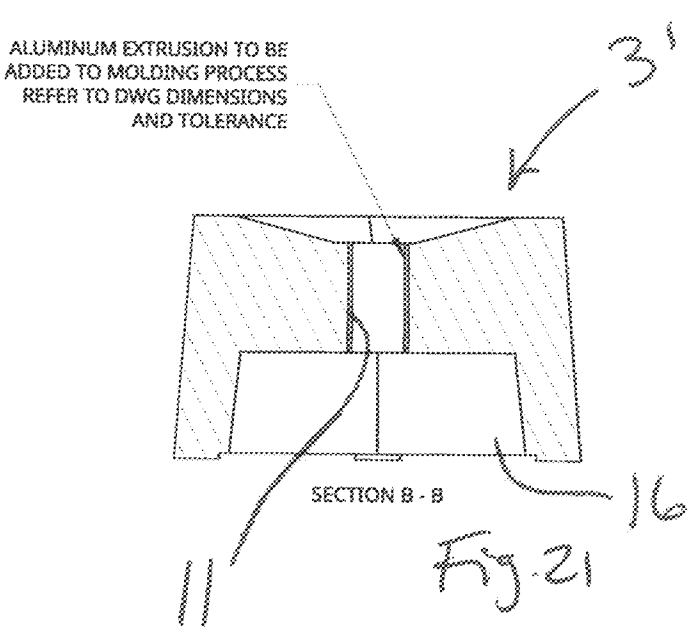
Fig. 21
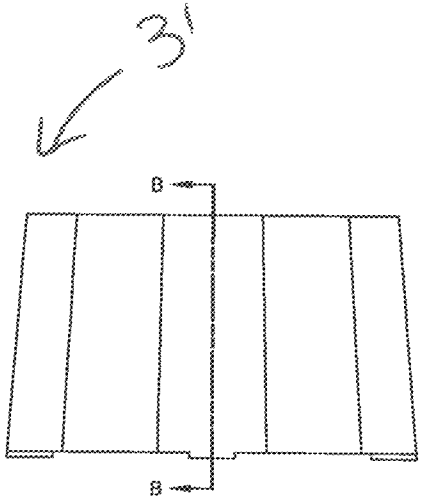
Fig. 20

12X PLATES
TRUE DIM.

OR

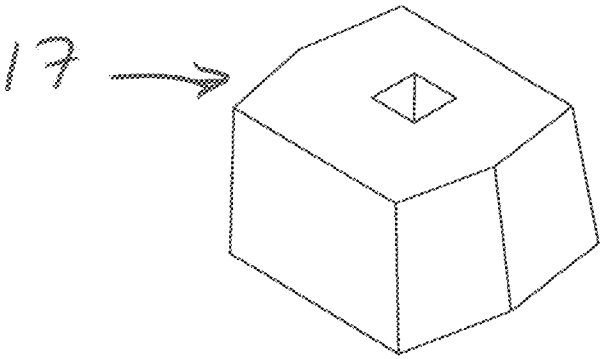
Fig. 31
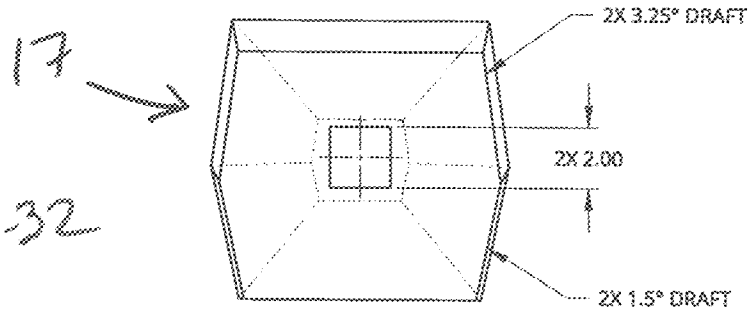
Fig. 32
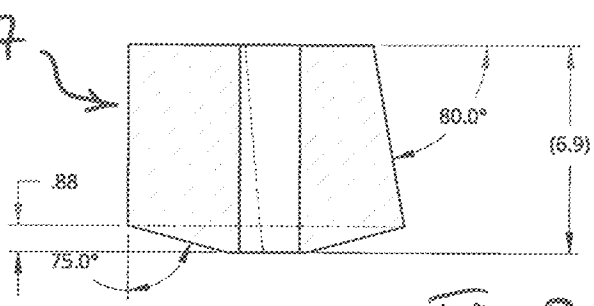
Fig. 33
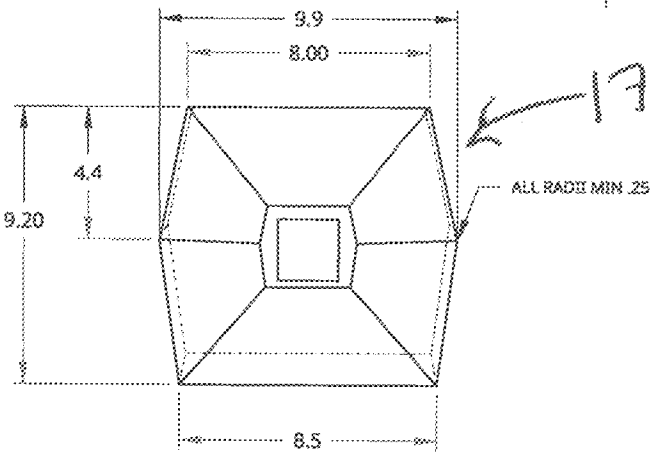
Fig. 34
Fig. 35

BILL OF MATERIALS

| ITEM NO | PART DESCRIPTION | OEM | OEM PART NUMBER | QTY |
|---|---|---|---|---|
| 1 | PRINTER COVER | - | - | 1 |
| 2 | SUPER STRUCTURE | - | - | 1 |
| 3 | THUMB SCREW | McMASTER-CARR | 91746A431 | 1 |
| 4 | WING NUT | McMASTER-CARR | 92001A321 | 1 |
| 5 | ANVIL | - | - | 1 |
| 6 | RUBBER BASE - TOP | - | - | 1 |
| 7 | RUBBER BASE - BOTTOM | - | - | - |

NOTE : FIBER GLASS POST NOT LISTED.

Our interactive kiosk goes beyond typical big box obtrusive stations by providing full function capability with the compact design of a typical tablet stand. Our revolutionary combination provides the opportunity for commanding attention with optimal presentation and positioning without blocking the view or path of users.

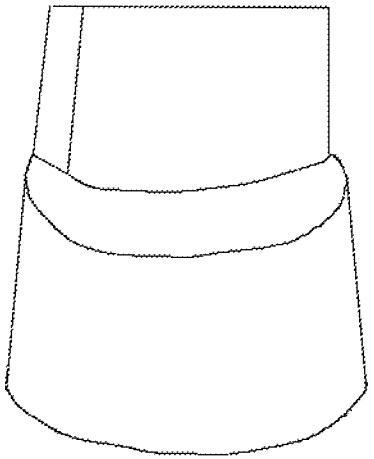

Shape, size and material of our technology provides resistance to tipping, sliding and lifting without employing typical obtrusive design as a cantilevered base plate of an over sized base projection.

Rubber base produced from compressed crumb rubber from recycled tires.

Rubber base minimizes impact of cleaning typical of floor standing objects over time.

Fig. 46A

Designed for construction without apparent seams of fastening components

Ergonomic analysis and human factor design delivers screens optimized for inclusion Constrasting textures of steel and rubber components add visual interest and intrigue.

Our ergonomically engineered interactive kiosk.

Unique design provides flexibility of application due to compact size. Our stand technology provides maximum stability at an affordable price.

Ideal for point-of-exit feedback, product ordering, menu display, voucher printing, wayfinding, product locating, punctual promotion

Fig. 46c

SMALL FORM FLOOR STANDING KIOSK FOR INTERACTIVE TECHNOLOGY DEVICES

CROSS REFERENCE TO RELATED APPLICATIONS

This Application is a Continuation of U.S. application Ser. No. 15/968,105 filed on May 1, 2018, and claims priority on U.S. Provisional Application No. 62/492,914 filed on May 1, 2017, which are herein incorporated by reference.

FIELD

The present subject-matter relates to a stand kiosk for the presentation to users, of both display and interaction technology devices, and, more particularly, to the manufacture and assembly of components made of dissimilar materials in the production thereof.

BACKGROUND

There are many products in the market as kiosks created to integrate technology equipment for interaction with people. Those available in the market are characterized by an often poor resolution of the numerous competing needs for: the method of manufacture, materials, size to stability issues, ergonomics, associated device concealment or attachment, maintenance access, and visual appeal as a free standing object.

Therefore, it would be desirable to provide a small form kiosk that takes into consideration these multiple competing factors.

SUMMARY

It would thus be desirable to provide a novel floor standing kiosk for interactive technology devices.

The embodiments described herein provide in one aspect a stand for a presenter, lecturer and the like, comprising a support structure, a base provided at a lower end of the support structure, and a device holding structure provided at an upper end of the support structure, wherein devices are adapted to be removably mounted to the device holding structure.

BRIEF DESCRIPTION OF THE DRAWINGS

For a better understanding of the embodiments described herein and to show more clearly how they may be carried into effect, reference will now be made, by way of example only, to the accompanying drawings, which show at least one exemplary embodiment, in which identical reference numerals in different figures indicate like elements and in which:

FIG. 1 is a three dimensional representation of an assembled small form floor standing kiosk, in accordance with an exemplary embodiment, for interactive technology devices;

FIG. 2 is a front elevation view of the floor standing kiosk of FIG. 1;

FIG. 3 is a vertical cross-sectional view of the floor standing kiosk, taken along line A-A of FIG. 2;

FIGS. 20 and 21 are respectively a side elevation view of the base and a vertical cross-sectional view taken along line B-B of FIG. 20, showing an aluminum extrusion added for the molding process;

FIGS. 22 and 23 are respectively a top plan view and a side elevation view of the aluminum extrusion referred to in FIGS. 20 and 21;

FIGS. 31, 32, 33 and 34 are respectively a three dimensional view, a top plan view, a side elevation view and a bottom plan view of a base top of use with the base of FIG. 15;

FIG. 35 is a vertical cross-sectional view of the base top of FIG. 31, taken along line A-A of FIG. 33;

FIG. 40 is an exploded three dimensional view of the kiosk, showing an assembly of the various components thereof;

FIGS. 46*a* and 46*b* are schematic three dimensional views respectively of a bottom section of the kiosk and of an upper portion of the superstructure of the kiosk, providing further details of such exemplary kiosks; and FIG. 46*c* is a schematic view providing further details of the exemplary kiosks.

DESCRIPTION OF VARIOUS EMBODIMENTS

Figure 4:
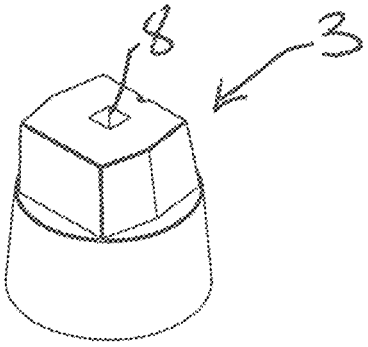
FIG. 4 is a three dimensional view of a compressed recycled crumb rubber base of the floor standing kiosk of FIG. 1, in accordance with an exemplary embodiment.
Figure 5:
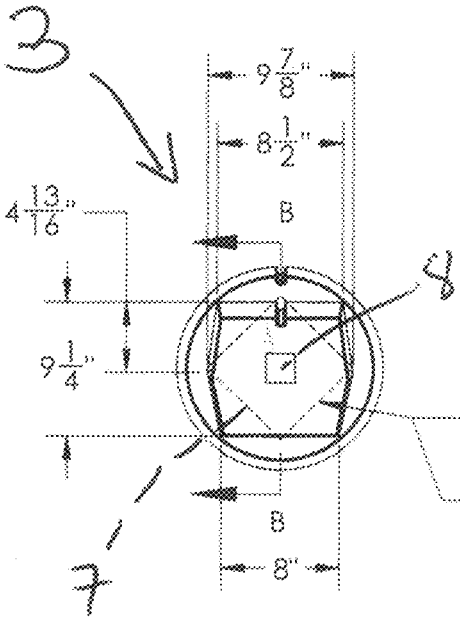
FIG. 5 is a top plan view of the compressed recycled crumb rubber base of FIG. 4.
Figure 6:
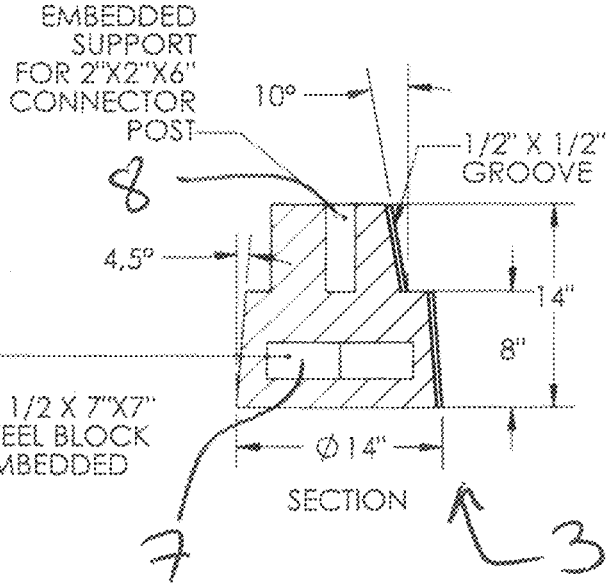
FIG. 6 is a vertical cross-sectional view of the compressed recycled crumb rubber base, taken along line B-B of FIG. 5.
Figure 7:
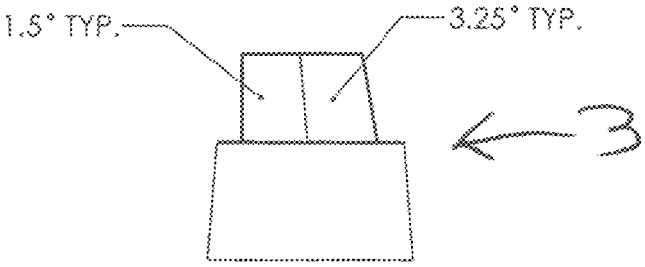
FIG. 7 is a side elevation view of the compressed recycled crumb rubber base of FIG. 4.
Figure 8:
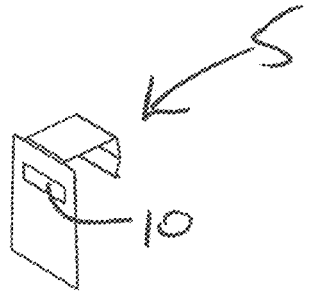
FIG. 8 is a three dimensional view of a spring plate of the floor standing kiosk of FIG. 1, in accordance with an exemplary embodiment.
Figure 9:
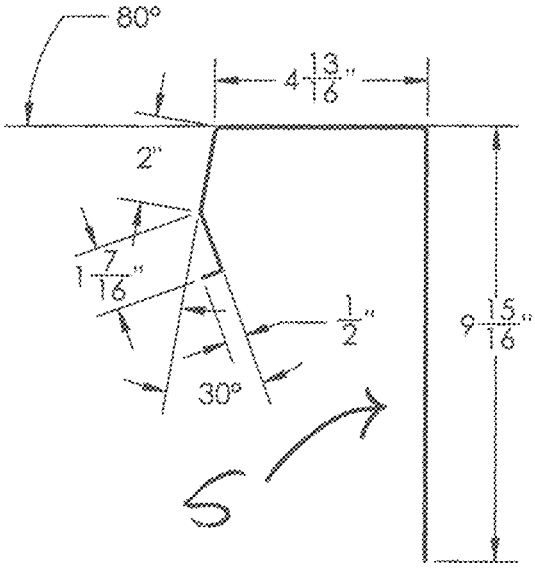
FIG. 9 is a vertical cross-sectional view of the spring plate.
Figure 10:
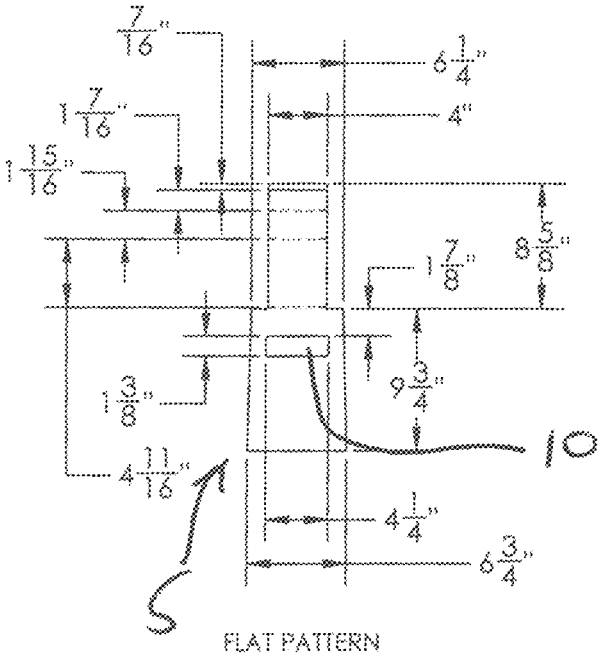
FIG. 10 is a flat pattern of the spring plate of FIG. 8, shown before folding.
Figure 11:
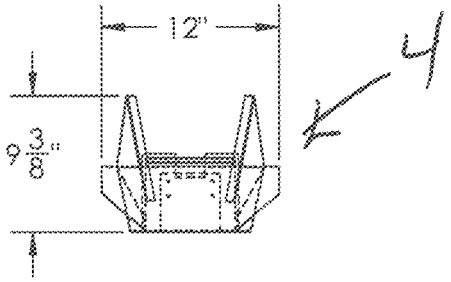
FIG. 11 is a top plan view of a steel base superstructure of the floor standing kiosk of FIG. 1, in accordance with an exemplary embodiment.

The present subject-matter is a new approach to the resolution of the aforementioned multiple competing factors. It is based in a unique approach to which materials are used, where, and how they can be used to overcome these competing constraints and create an improved product, cost and user experience.

It is configured and dimensioned for high ergonomics of human form interaction. The present subject-matter takes the form of a small form kiosk that integrates and conceals the various non-included components in its small size. The purpose of the kiosk is to provide small, attractive and efficient support. It is used for disseminating, collecting, sharing information, and outputting physical vouchers.

The present kiosk includes integration of these devices and other devices adding physical output, and sensory feedback. This unit is for use wherever a floor standing installation can be deployed to serve people standing upright.

The present kiosk is compact, stable, attractive, and non-intrusive, and it is achieved by a unique combination and connection of materials and manufactures; for instance, one of compressed recycled crumb rubber, another of folded and then tack welded metal plate requiring, for example, only a two-screw connection between these two elements, and a third also of folded metal. Attachment of, and access to multiple associated devices is concealed and requires a significantly low number of physical connectors.

In an embodiment, as seen for instance in FIG. 1, a stand, or kiosk, K is disclosed, which provides a small form support for any type of device that displays information or invites interaction. It is designed for any presentation of information and/or collection of input with a combination of any devices 1 of suitable weight and size. It is designed to sit on the floor and present the device to an individual 2 who is standing.

The construction of the stand or kiosk K integrates significant functional requirements of human ergonomics, a small form, a unique integration of materials, and uses crumb rubber from recycled tires with any metal bent from sheet. More particularly, the kiosk K includes a rubber base 3, made for instance of compressed recycled tire crumbs; a superstructure 4, made for instance of ant type of bent/folded sheet metal; and a spring plate 5 provided at an upper end of the superstructure 4.

The rubber lower base 3 can integrate various choices of colour, and the upper metal superstructure 4 can be of many types of metal finish, perforation, pattern, applied colour, coating or applied chemical technique, applied to the base metal. This can also include applications of wrapping of the metal component with decorative applied film designs that are installation location specific.

The stand or kiosk K is made with two manufactures and a variety of pieces and attachments that are then assembled together.

The display stand or kiosk K integrates two primary manufactures into a single object. The first is compressed crumb rubber from recycled tires creating the stable base form, e.g. the base 3. The second is folded plate metal providing the vertical support, e.g. the superstructure 4, which includes an affixation plate 6 for non-included devices. Combined in the assembly they become a distinct assembly, composition, and resolution creating a functional object that optimizes its configuration for human ergonomic standards.

The base 3 is manufactured by typical process and machinery for compression moulding of recycled 'crumb rubber' pellets. The base 3 includes a steel counterweight 7 that is placed within the rubber during the filling and compressing sequence so as to arrive at the specified location upon completion of the compression.

A top square opening 8, of 2 inch by 2 inch by 6 inches deep, is created by moulding into, and flush with the top surface, a section of square aluminum tube. This tube is anchored with 2 transverse ¼ inch diameter by 6 inch long aluminum rods welded to the tube at the mid-point, these are concealed within the rubber when compressed. In lieu of the aluminum this insert assembly can alternatively be made of similarly sized square steel tube and ¾ inch by ¾ inch steel angles by six inches welded to two opposite sides at mid-point.

The superstructure 4 is made with sheet metal that is cut and then bent according to a folding diagram. Various metals, from 16 to 20 gauge, can be used. Various metal surfaces and/or perforation patterns may be used. Various surfacing techniques may be used. The superstructure 4 may have paint applied by any process.

The sheet metal is laser cut and folded or bent with typical machinery and processes. Tack welds connect contact points of the folded result. This metal superstructure 4 is now ready to be installed on the rubber base 3.

Figure 12:
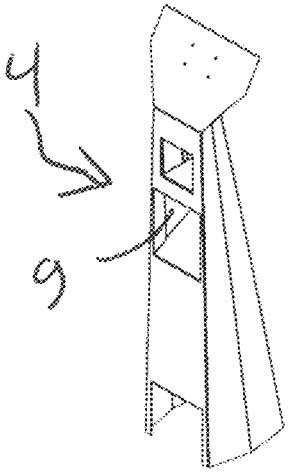
FIG. 12 is a three dimensional view of the steel base superstructure of FIG. 11.
Figure 13:
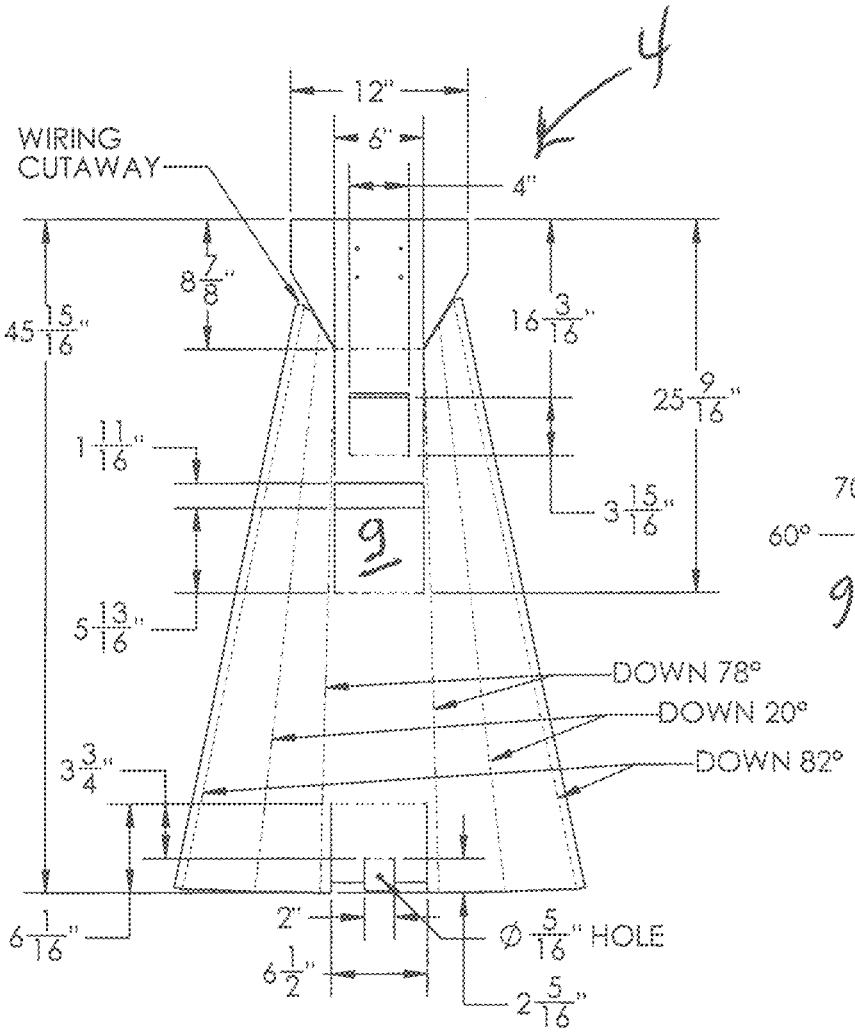
FIG. 13 is a flat pattern of the steel base superstructure of FIG. 12, shown before folding.
Figure 14:
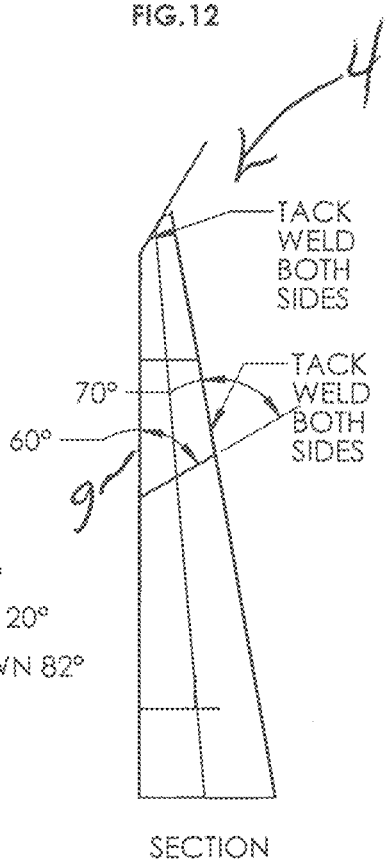
FIG. 14 is a vertical cross-sectional view of the steel base superstructure.
Figure 15:
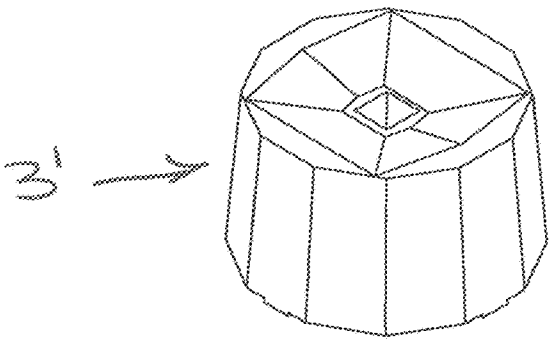
FIG. 15 is a three dimensional view of a compressed recycled crumb rubber base for a floor standing kiosk, in accordance with another exemplary embodiment.
Figure 19:
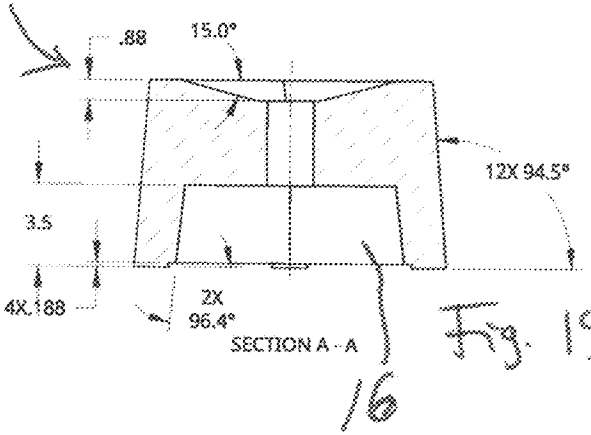
FIG. 19 is a vertical cross-sectional view of the base of FIG. 16, taken along line A-A of FIG. 17.
Figure 16:
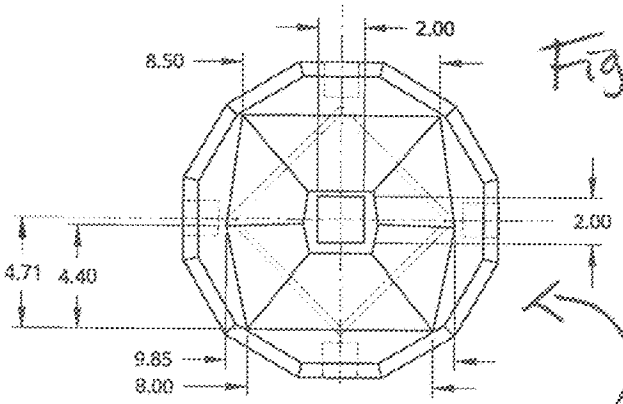
FIGS. 16, 17 and 18 are respectively top plan, side elevation and bottom plan views of the base of FIG. 15.
Figure 17:
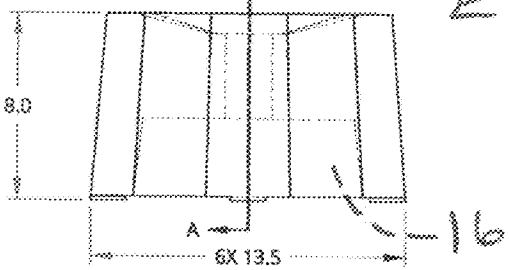
Figure 18:
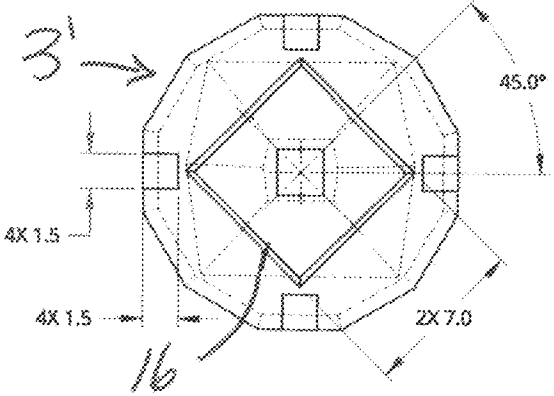
Figure 24:
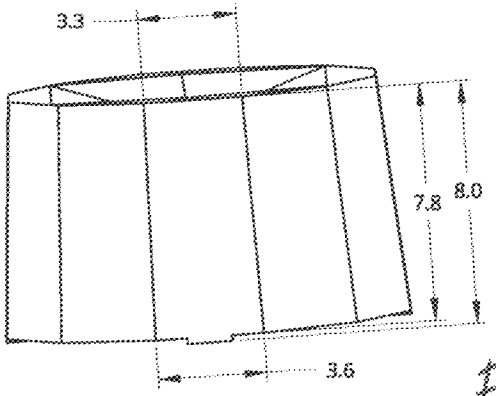
FIGS. 24 and 25 are respectively a three dimensional view and a side elevation view of the base of FIG. 15.
Figure 25:
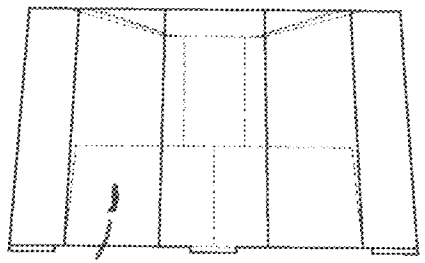

An additional metal clip plate 5 (spring plate) is also made by cut and bent from similar sized plate metal. Once folded this plate 5 becomes a clip that inserts through specifically sized openings 9 in the superstructure 4 to hold a receipt printer, or alternative, in place (see FIGS. 2, 3 and 12). An opening 10 in the clip plate 5 is co-ordinated with the dimensions of an associated printer. This is sized so as to conceal the printer within, hold the printer tightly in appropriate position, and to provide for a printed paper voucher to be presented to the user at a reach appropriate height and location.

Attachment of the two main components, namely the base 3 and the superstructure 4 is accomplished in the following three steps.

Firstly, the metal superstructure 4 is slid down over the top of the base 3, where tension, friction, and the mortise over tenon effect provide the necessary connection therebetween.

Secondly, a length of fibreglass square tube is inserted in the top opening 8 in the center of the base 3 and secured in place by way of screws or alternate attachment.

Thirdly, a bolt and nut, with lock washers, are placed and secured through the hole in the metal superstructure 4 attachment flap and the aligned hole in the vertical center tube now attached in the rubber base 3.

The kiosk's qualities are integral to the form, materials, detail and surface treatments afforded by the materials and their manufacture. Embodied by: the slenderness, the footprint shape and size of the base 3 that produces the stability and gravity defying appearance; the effect of presenting any associated device 1 perched as the pinnacle feature at the top of an iconic presentation style support shape or superstructure 4; the varying sizes, shapes and angles of the front and side facets of the folded metal of the superstructure 4, which add a perception of vertical convergence; and the curvature, in plan, of the base 3, wherein the visual design is integral to functional tipping resistance.

The present kiosk K has no apparent seems or physical connectors. The kiosk K has hidden connection of component pieces, minimal mechanical fastenings, and no apparent fastening of components, with concealed cable management between associated equipment. It conceals subcomponent mounting by employing gravity and minimum mechanical fastening, and provides a minimally sized enclosure for a thermal printer, small form computer, or other similarly sized devices.

Figure 26:
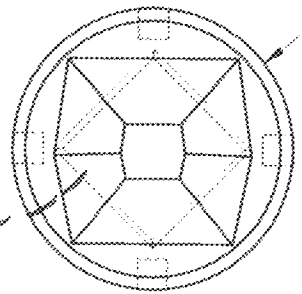
FIGS. 26 and 27 are respectively a top plan view and a side elevation view of a base for a floor standing kiosk, in accordance with still another exemplary embodiment.
Figure 27:
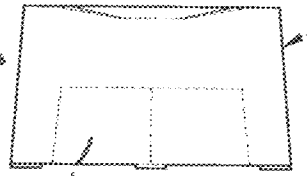
Figure 28:
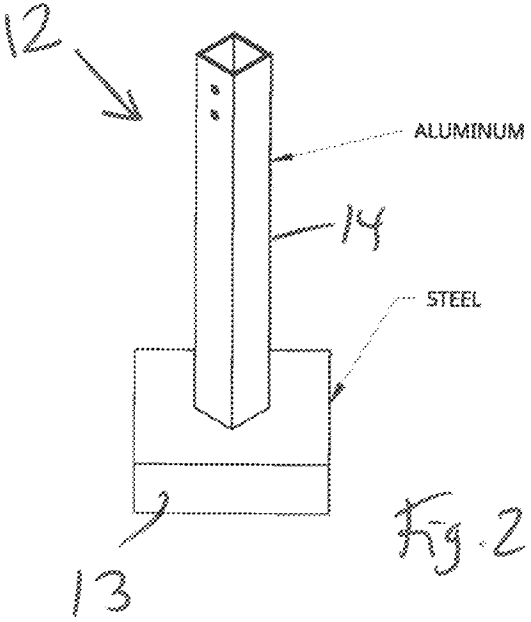
FIGS. 28, 29 and 30 are respectively a three dimensional view, a side elevation view and a top plan view of an anvil for use with the base of FIG. 15.
Figure 30:
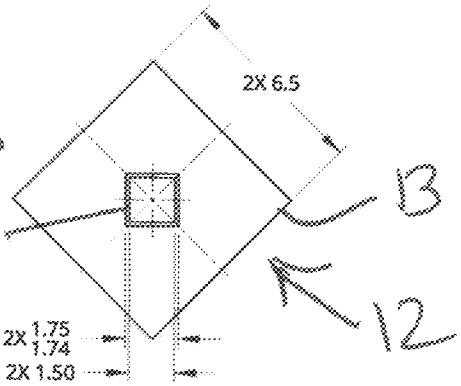
Figure 29:
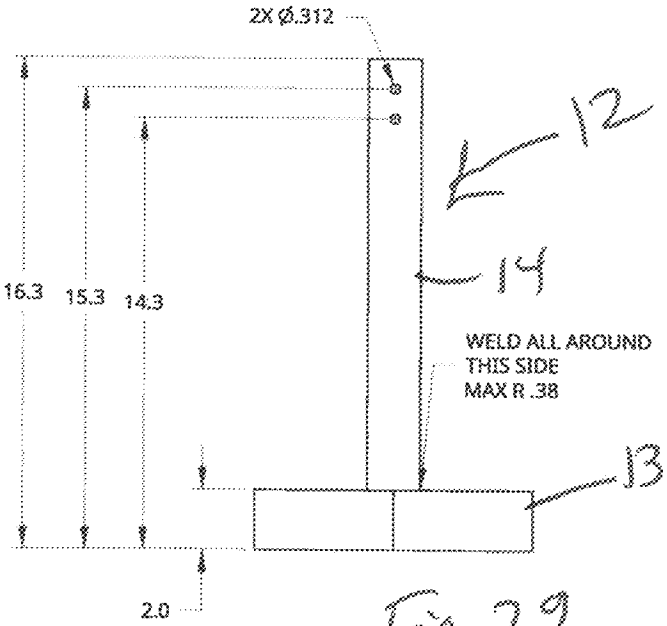
Figure 38:
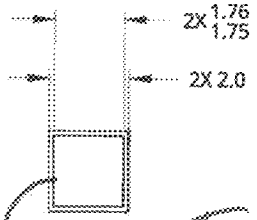
FIGS. 38 and 39 are respectively a top plan view and a side elevation view of the aluminum extrusion referred to in FIGS. 36 and 37.
Figure 39:
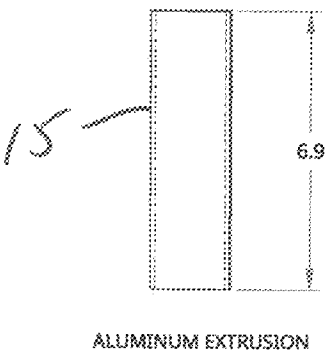
Figure 37:
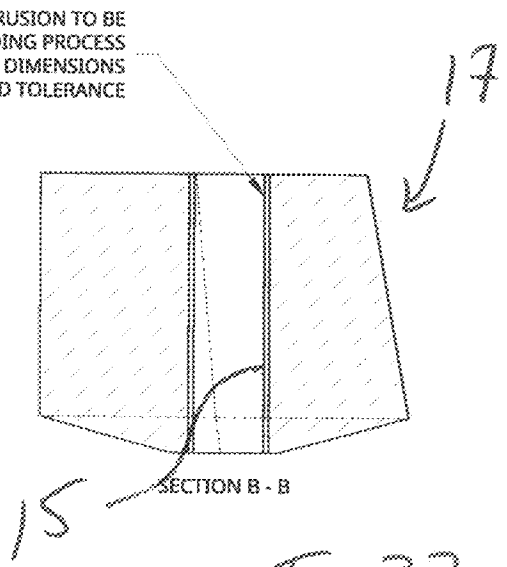
FIGS. 36 and 37 are respectively a side elevation view of the base top of FIG. 31 and a vertical cross-sectional view taken along line B-B of FIG. 36, showing an aluminum extrusion added for the molding process to the base top.
Figure 36:
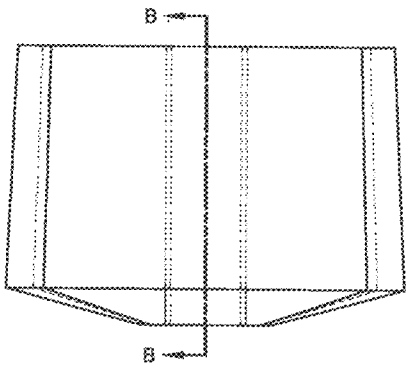
Figure 4B:
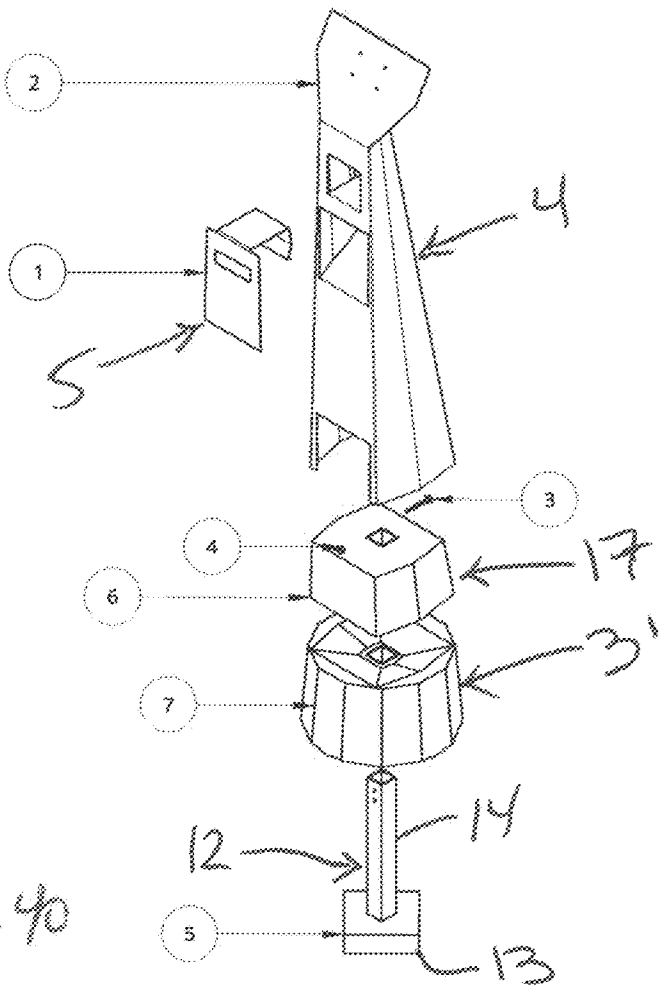
Figures 41, 42, 43, 44:
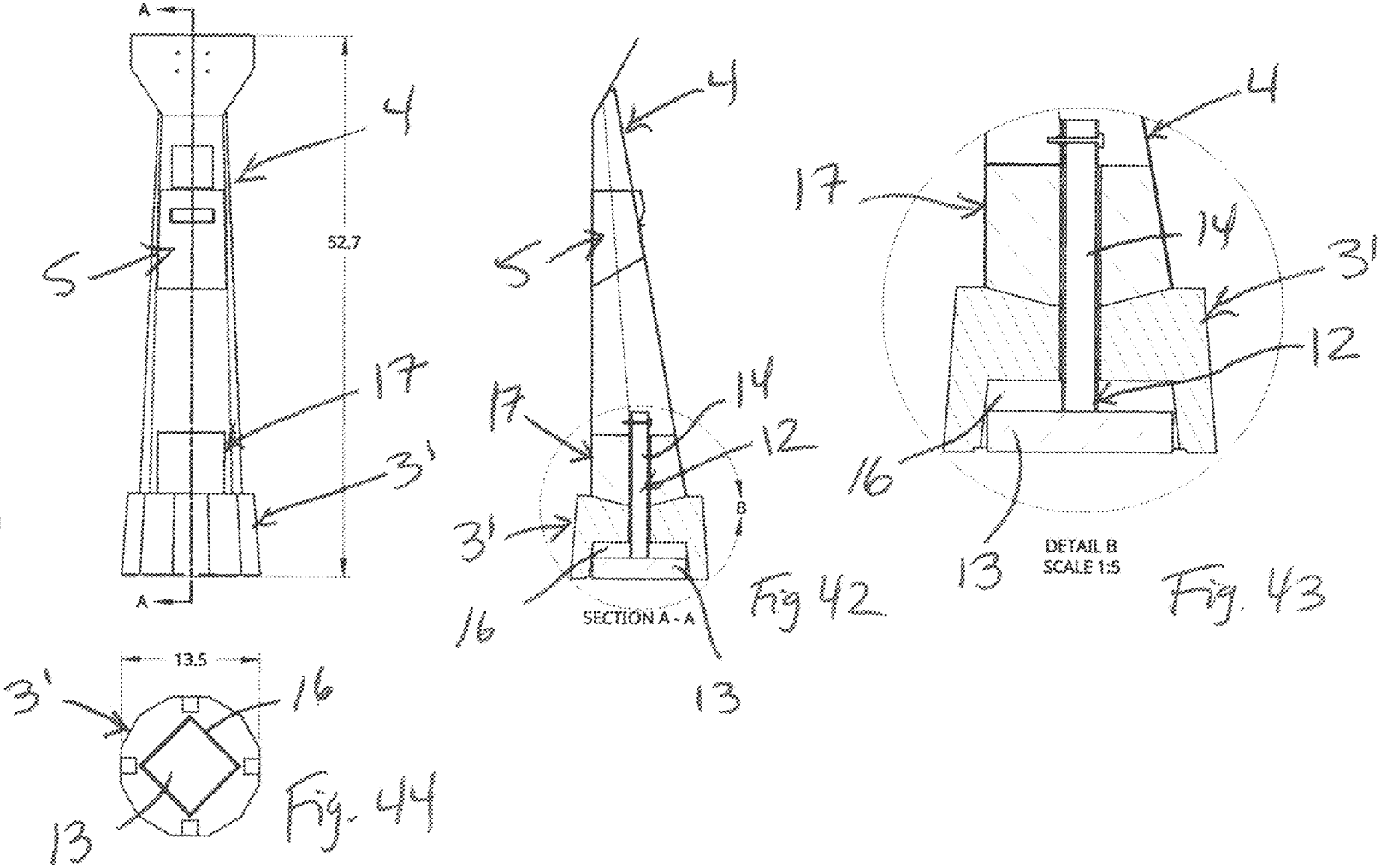
FIG. 41 is a front view of the kiosk of FIG. 40, shown in an assembled state.
FIG. 42 is a vertical cross-sectional view of the assembly, taken along line A-A of FIG. 41.
FIG. 43 is an enlarged view of the section of the assembly, encircled by line B-B in FIG. 42.
FIG. 44 is a bottom plan view of the assembled kiosk of FIG. 41.
Figure 45:
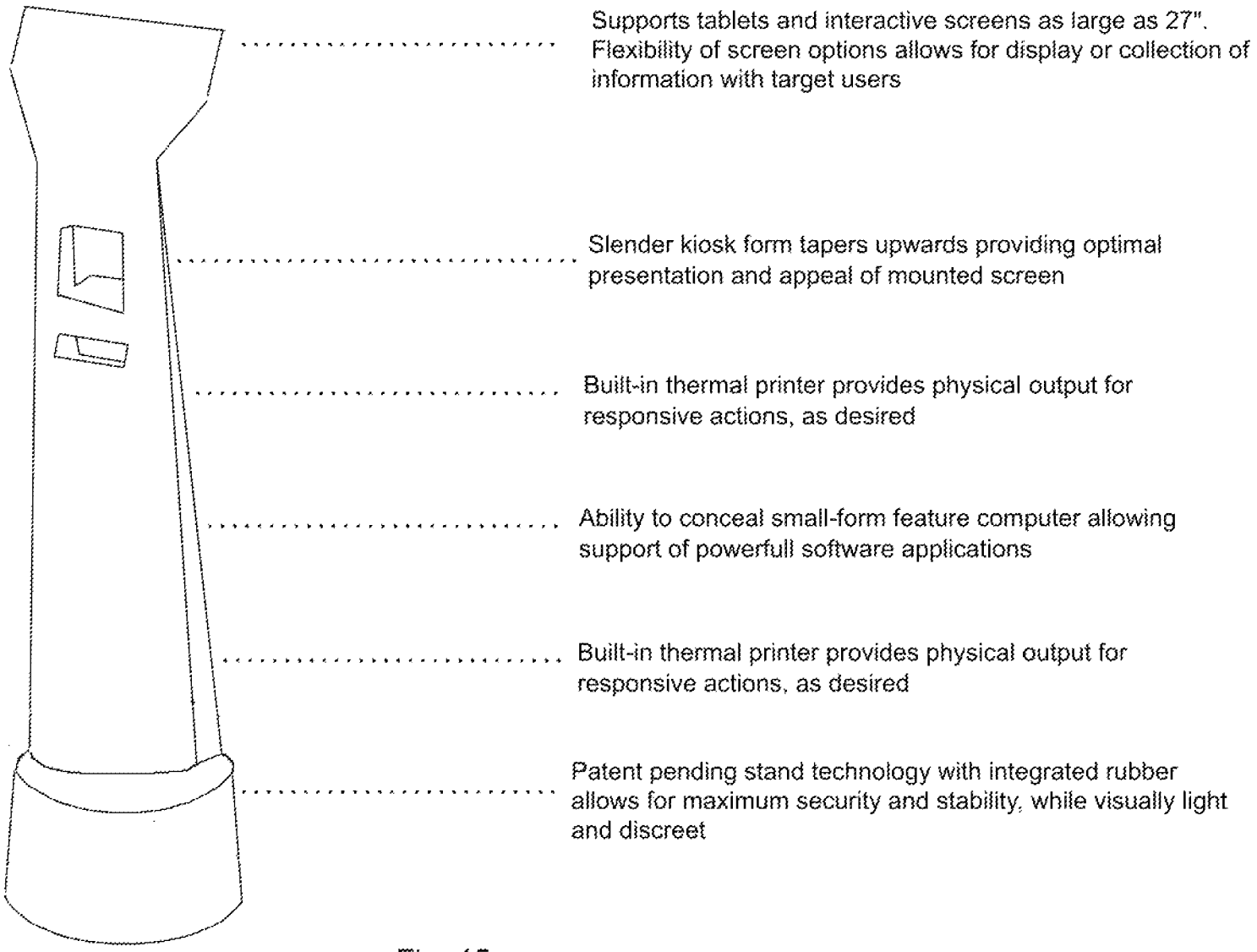
FIG. 45 is a schematic three dimensional view of the kiosk of FIG. 2, emphasizing some features of such exemplary kiosks.
Figure 46B:
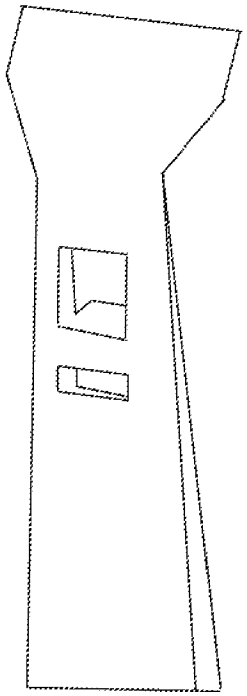

Alternative bases, such as base 3' of FIGS. 15 to 21, 24, 25 and 40 to 44 as well as base 3" of FIGS. 26 and 27, are also disclosed, wherein these rubber bases are comprised of independently molded components of compressed recycled crumb rubber. The interlocking components are assembled with either the aforementioned fibreglass post or with a steel anvil 12 as shown in FIGS. 28 to 30 (the anvil being shown in isolation) and 40 to 44 (the anvil being shown with the kiosk assembly).

The purpose is of the bases 3' and 3" is to provide an assembly comprised of lesser weight components, which benefit shipping, handling and assembly. For instance, each component is less than 48 pounds Imperial weight.

An additional purpose of the bases 3' and 3" is to provide an option to the present kiosk, which option provides additional total weight and a lower centre of gravity for use in installation locations subject, for example, to more abuse. The steel anvil 12, which includes a base 13 and a welded steel post 14, will be an additional component added for such situations. The anvil 12 may be varied in weight by increasing or decreasing the thickness, shape or size of the bottom steel block, i.e. of its base 13. The shape, dimensions and depth of a recess 16 in the bottom rubber component (base 3' or 3") may vary to accommodate other shapes, sizes or weights of anvil.

A base top 17 can also be provided, as seen in isolation in FIGS. 31 to 37 and in use in the kiosk assembly of FIGS. 40 to 44.

Aluminum extrusions 11 and 15 are used in the (square) holes of the base 3' or 3" and of the base top 17 during the molding thereof.

These iterations of the bases also show options for the bottom compressed recycled rubber sub component to be produced in the shape of a facetted cone (e.g. see FIG. 15) or as a smooth conical shape (e.g. see FIG. 27). This allows for the steel molds required for manufacture of the compressed recycled crumb rubber bases to be produced by either cut, weld and polish process or to be milled from a solid block of steel.

FIGS. 45 and 46*a* to 46*c* provide further details regarding the present kiosk designs, including on some of the features thereof.

Therefore, the present kiosks combine a compress formed recycled rubber base with a folded plate metal superstructure. The base conceals a metal counterweight, and additional attachments in a variation of mortise and tenon type connection between the rubber base and the metal superstructure. The superstructure is cut and folded from sheet metal in a manner so as to provide an adequately rigid structural shape and to support and conceal associated devices, provide appropriate structural performance, and require a minimum of mechanical attachments to associated devices. Gravity based seating of components and/or tension clipped brackets position and hold additional associated devices. Cable management is provided within the superstructure by the shape of the folds and the sizing of cut and folded plates, so as to create a vertical channel that contains and conceals wiring.

The shape, size and dimensions of the kiosks are specifically created to improve upon the head, eye, neck, shoulder, arm and hand positioning for the users. The positioning of any attached screen relative to the superstructure and base provides for users to position their feet and body without impediment from projections, providing the 'toe kick' clearance effect typical in kitchen counter designs.

The kiosk designs thus embody an experiential optimum with the human form of users, the positioning, dimensioning and angles of attachment plate, the height and reach dimensioning combined with the minimal projection of the base towards user's foot position. The overall effect is an object embracing human factors within a clean, sleek integration without sacrificing structural or physical efficacy.

The following points are also provided:

1. The manufacture and assembly of the Small form floor standing kiosk for interactive technology devices comprising:
   - the materials, dimensions, form, and methods of the assembled unit comprised of the components of Compressed Recycled Crumb Rubber Base, Steel Base superstructure, Spring Plate and associated connectors
2. The Compressed Recycled Crumb Rubber Base for a Steel Base superstructure
   - with the round bottom shape that counters overturning
   - the embedded support for connector post
   - the concealed steel block embedded counterweight
   - the shape creating the tenon top projection
3. The manufacture of the Steel Base superstructure for a Compressed Recycled Crumb Rubber Base
   - with the folded metal sheet and tack welded for a Compressed Recycled Crumb Rubber Base
   - the cut out and fold-in configuration of the Steel Base superstructure to integrate and support associated devices
   - the cut out for pass through that provides for combination with the Spring Plate clip manner of device attachment
   - the dimensional configuration and the form of the folded metal plate superstructure specific to providing its ergonomic presentation.
   - the mortise shape of folded metal of the Steel Base superstructure that provides for attachment to a Compressed Recycled Crumb Rubber Base
   - the cut and fold in the metal providing the upturned tongue with hole, and with the resulting horizontal side plates, for solid connection to a connector post and between the components of the assembly
4. The Spring Plate to provide concealed placement and attachment of associated devices without mechanical fastening
   - the shape and configuration of a Spring Plate that conceals and secures in place any associated equipment such as a receipt printer or other device
   - the spring plate with an integral cut-out opening dimensioned for the pass through emission of paper receipt or other.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

The invention claimed is:

1. A self-supporting floor stand for a presenter, comprising a support structure, a base provided at a lower end of the support structure, and a device holding structure provided at an upper end of the support structure, wherein the support structure defines a cavity for accommodating auxiliary devices and is provided with a plate at the cavity, wherein the plate includes a spring plate adapted to at least partly cover the cavity.

2. The self-supporting floor stand of claim 1, wherein the device holding structure includes an affixation plate, and wherein devices are adapted to be removably mounted to the affixation plate.

3. The self-supporting floor stand of claim 2, wherein the affixation plate extends at angle appropriate for the presenter standing before the stand.

4. The self-supporting floor stand of claim 2, wherein the devices include at least one of information-displaying devices and interaction-inviting devices.

5. The self-supporting floor stand of claim 1, wherein the device holding structure is adapted for securing auxiliary devices to an underside thereof.

6. The self-supporting floor stand of claim 5, wherein the device holding structure extends at angle appropriate for the presenter standing before the stand, and wherein the auxiliary devices are adapted to be mounted to the underside of the device holding structure.

7. The self-supporting floor stand of claim 5, wherein the auxiliary devices are adapted to be mounted in a removable manner to the underside of the device holding structure.

8. The self-supporting floor stand of claim 5, wherein the auxiliary devices include at least one of a rear projector, a wall wash lighting source, a lighting source and a down-lighting source.

9. The self-supporting floor stand of claim 1, wherein the support structure is adapted for securing auxiliary devices thereon.

10. The self-supporting floor stand of claim 9, wherein the auxiliary devices are adapted to be mounted in a removable manner to the support structure.

11. The self-supporting floor stand of claim 9, wherein the auxiliary devices include at least one of a computer and a printer.

12. The self-supporting floor stand of claim 1, wherein the base is at least partly made of rubber.

13. The self-supporting floor stand of claim 12, wherein the rubber includes compressed recycled tire crumbs.

14. A self-supporting floor stand for a presenter, comprising a support structure, a base provided at a lower end of the support structure, and a device holding structure provided at an upper end of the support structure, wherein the support structure defines a cavity for accommodating auxiliary devices and is provided with a plate at the cavity, wherein the support structure is at least partly made of bent sheet metal.

15. A stand for a presenter, comprising a support structure, a base provided at a lower end of the support structure, and a device holding structure provided at an upper end of the support structure, wherein devices are adapted to be removably mounted to the device holding structure, and wherein the device holding structure defines a cavity adapted to accommodate auxiliary devices and is provided with a plate at least partly covering the cavity, wherein the plate includes a spring plate adapted to at least partly cover the cavity.

16. The stand of claim 15, wherein the device holding structure extends at an angle appropriate for the presenter standing before the stand, and wherein the device holding structure includes an affixation plate, and wherein devices are adapted to be mounted to an underside of the affixation plate.

17. The stand of claim 16, wherein the devices are adapted to be removably mounted to the underside of the affixation plate.

18. A stand for a presenter, comprising a support structure, a base provided at a lower end of the support structure, and a device holding structure provided at an upper end of the support structure, wherein devices are adapted to be removably mounted to the device holding structure, and wherein the support structure defines a cavity for accommodating auxiliary devices and is provided with a spring plate adapted to at least partly cover the cavity.

* * * * *